US006729240B1

(12) United States Patent
Smith et al.

(10) Patent No.: US 6,729,240 B1
(45) Date of Patent: May 4, 2004

(54) IGNITION ISOLATING INTERRUPT CIRCUIT

(75) Inventors: Gregory H. Smith, Placentia, CA (US); David M. Wheeler, Laguna Hills, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/304,495

(22) Filed: Nov. 26, 2002

(51) Int. Cl.[7] ..... F42C 15/40; F42C 15/00
(52) U.S. Cl. ..... 102/206; 102/262; 102/221
(58) Field of Search ..... 102/206, 222, 102/237, 244, 262, 221

(56) References Cited

U.S. PATENT DOCUMENTS 3,964,395 A * 6/1976 Kaiser et al. ..... 102/218
4,378,738 A 4/1983 Proctor et al.
4,651,646 A * 3/1987 Foresman et al. ..... 102/208
4,726,291 A * 2/1988 Lefranc ..... 102/214
4,769,734 A * 9/1988 Heinemeyer et al. ..... 361/56
4,848,232 A * 7/1989 Kurokawa et al. ..... 102/200
5,363,765 A * 11/1994 Aikou et al. ..... 102/220
5,476,044 A * 12/1995 Boucher ..... 102/218
6,196,130 B1 * 3/2001 Crist et al. ..... 102/221
6,267,326 B1 7/2001 Smith et al.
6,584,907 B2 * 7/2003 Boucher et al. ..... 102/217

* cited by examiner

*Primary Examiner*—Michael J. Carone
*Assistant Examiner*—James S. Bergin
(74) *Attorney, Agent, or Firm*—William C. Anderson

(57) ABSTRACT

An ignition isolating interrupt control circuit (52) includes a main transition circuit (90) isolating a first activation circuit (84) from an ignition circuit (114). The main transition circuit (90) includes a source terminal (93) that is electrically coupled to and receives a first source power from the first activation circuit (84). An input terminal (106) is electrically coupled to a second activation circuit (88) and receives an activation signal. An output terminal (138) is electrically coupled to the ignition circuit (114) and receives and supplies the first source power to the ignition circuit (114) in response to the activation signal. A power source monitor cutoff circuit (112) including a comparator is electrically coupled to the first activation circuit (84) and to the ignition circuit (114) and disables the ignition circuit (114) when a source voltage level is less than a predetermined voltage level.

18 Claims, 5 Drawing Sheets

IGNITION ISOLATING INTERRUPT CIRCUIT

"This invention was made with government support under contract number N00024-98-C-5364 awarded by the United States Navy. The government has certain rights in this invention."

TECHNICAL FIELD

The present invention relates generally to circuitry for arming and disarming an electronic device, and more particularly, to a method and circuit for isolating an activation circuit from an ignition circuit.

BACKGROUND OF THE INVENTION

Flight and other operational characteristics of an unmanned vehicle or weapon system, such as a missile, are controlled via a guidance processor in conjunction with other electronics. The guidance processor activates squibs or ordnances to ignite propellant within a combustion chamber and selectively activates valves that obtain fuel from the combustion chamber to propel and direct the weapon system towards a target.

Various safety requirements are imposed on weapon systems to ensure safe handling and transportation and to ensure proper detonation of the weapon system. Weapon systems are typically designed to meet a single system malfunction tolerant requirement and provide a low probability of system malfunction.

Thus, as one safety measure, in many known weapon systems, various devices are used to isolate activation circuitry from ignition circuitry. The activation circuitry is determinative of when propellant is ignited and the ignition circuitry actually ignites the propellant in response to an enable signal from the activation circuitry. For example, typically within larger weapon systems, mechanical relays are employed to fully isolate activation circuitry from ignition circuitry, which is sometimes referred to as a firing train interruption. The mechanical relays are large in size and are of considerable weight.

A current desire exists to implement similar isolation circuitry within smaller weapon systems, such as within kinetic warheads, to isolate activation power from an ignition circuit or series of squibs. Unfortunately, use of mechanical relays and the like is not feasible within the confined available space of a kinetic warhead, as well as in other unmanned vehicles.

Also, unmanned vehicles commonly have stringent restrictions on maximum permissible weight without hampering vehicle performance, therefore, it is preferred that the isolation circuitry be relatively light in weight in order for proper flight operation performance.

Additionally, current control circuits of smaller unmanned vehicles can experience a bleed down situation, upon which digital electronics contained therein can be in an indeterminate state and can inadvertently ignite the squibs at an inopportune time. For example, when a supply voltage is inadvertently activated and remains in an "ON" state, over time the supply voltage eventually drains and drops below a predetermined voltage level causing a guidance processor of the unmanned vehicle to function inappropriately.

It is therefore desirable to provide a circuit that meets the isolation requirements for safely isolating an activation circuit from an ignition circuit within a smaller scale unmanned vehicle that is relatively small in size, relatively light in weight, and provides a low probability of system malfunction.

SUMMARY OF THE INVENTION

The present invention provides a method and circuit for isolating an activation circuit from an ignition circuit. An ignition isolating interrupt control circuit is provided. The circuit includes a main transition circuit isolating a first activation circuit from an ignition circuit. The main transition circuit includes a source terminal that is electrically coupled to and receives a first source power from the first activation circuit. An input terminal is electrically coupled to a second activation circuit and receives an activation signal. An output terminal is electrically coupled to the ignition circuit and receives and supplies the first source power to the ignition circuit in response to the activation signal. A power source monitor cutoff circuit including a comparator is electrically coupled to the first activation circuit and to the ignition circuit and disables the ignition circuit when a source voltage, level is less than a predetermined voltage level.

One advantage of the present invention is that it safely isolates an activation circuit from an ignition circuit within relatively smaller unmanned vehicles and accounts for bleed down situations.

Another advantage of the present invention is that it provides an ignition isolating interrupt control circuit that is relatively small in size, relatively light in weight and inexpensive, and yet durable.

Furthermore, the present invention has a low probability of system malfunction, which is lower than what is typically required of such vehicles.

Moreover, the present invention provides an ignition isolating interrupt control circuit with increased malfunction tolerance.

The present invention itself, together with further objects and attendant advantages, will be best understood by reference to the following detailed description, taken in conjunction with the accompanying drawing.

DETAILED DESCRIPTION OF THE PREFERRED EMBODIMENT

Figure 1:
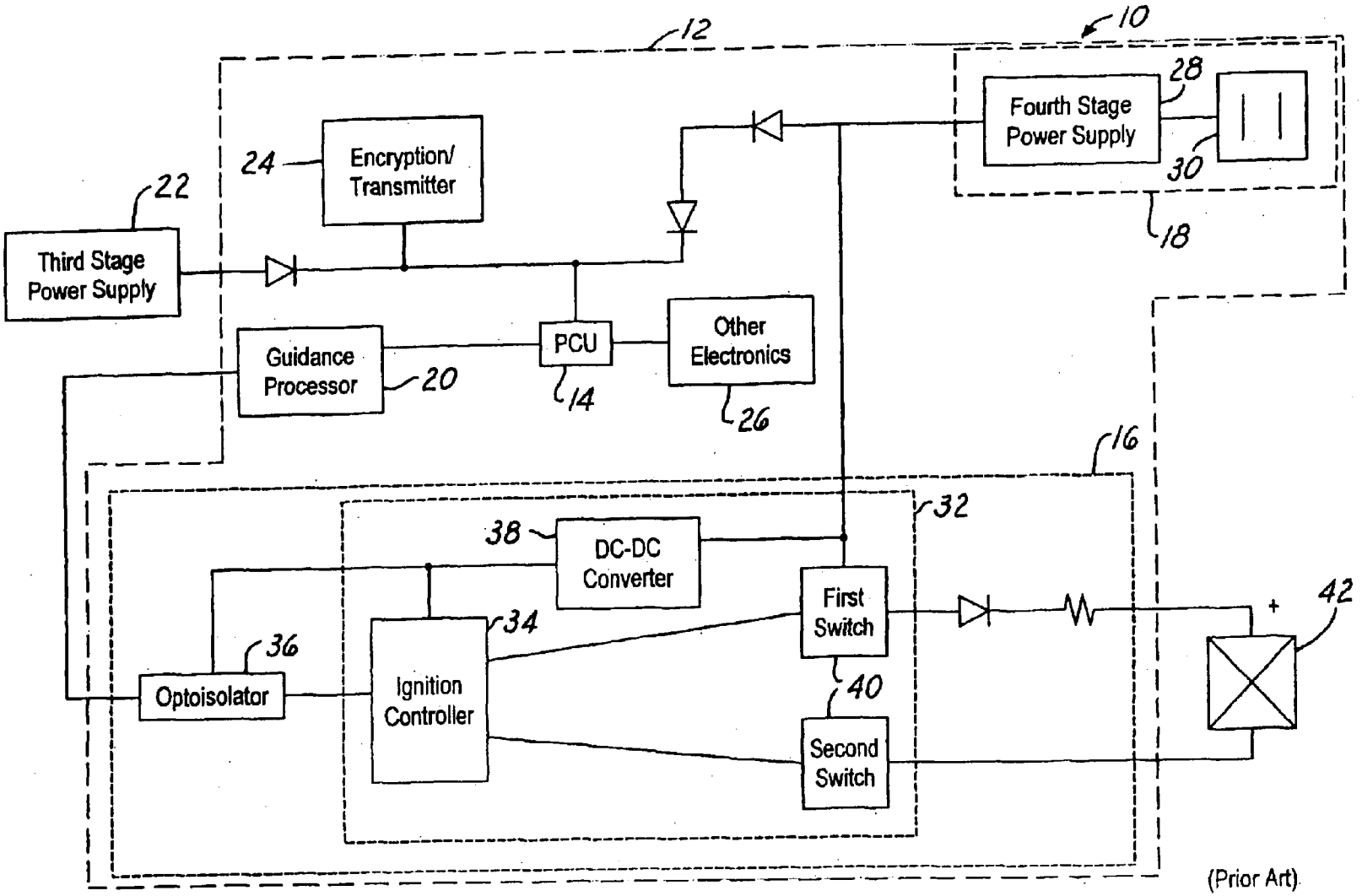
(Prior Art) FIG. 1
FIG. 1 is a schematic diagram of a traditional control circuit for a kinetic warhead.

Referring now to FIG. 1, a schematic diagram of a traditional control circuit 10 for a kinetic warhead of a missile is shown. Missiles that have a kinetic warhead, in general, typically transition between four operating stages before the warhead impacts a target. The control circuit 10 transitions between a third stage and a fourth stage and performs various functions utilizing the guidance assembly circuit 12. The activation circuit 18 is coupled to and supplies power to the ordnance valve driver 16.

The guidance assembly circuit 12 includes a guidance processor 20 that determines heading and operational performance of the warhead. The guidance assembly circuit 12 further includes a third stage power source 22 supplying power to an encryption/transmitter device 24 and the power control unit (PCU) 14, which may be coupled to other electronic components, as designated by box 26.

The activation circuit 18 includes a fourth stage power supply or battery 28 and an acceleration switch 30, which is sometimes referred to as a G-switch. When the warhead exceeds a predetermined acceleration, the power supply 28 is activated, thus supplying power to the ordnance valve driver 16.

The ordnance valve driver 16 includes an ignition circuit 32 having an ignition controller 34, which receives an enable signal from the guidance processor 20 through an optoisolator 36. A direct current to direct current (DC—DC) converter 38 converts a voltage level of the power supply 28 to a common logic 5V to power the ignition controller 34. The ignition controller 34 in response to the enable signal switches a pair of switches 40 to an "ON" state to ignite electro-explosive devices 42, thus igniting a propellant that is ignited in three separate stages and has three redundant channels. The ordnance valve driver 16, typically, contains 12 independent switches (eleven channels not shown), each of which are controlled from the ignition controller 34. Five of the switches are used to activate valves, six of the switches are used to ignite electro-explosive devices, and the remaining switch is used as a spare channel.

The circuit 10 as shown may inadvertently enable the ignition circuit 32 before enablement of the fourth stage. The circuit 10 does not satisfy current isolation requirements for safely isolating the activation circuit 18 from the ignition circuit 32 and further does not provide adequate precautionary devices to prevent bleed down situations from occurring, which are both overcome by the present invention as described below.

In each of the following figures, the same reference numerals are used to refer to the same components. While the present invention is described with respect to a method and circuit for isolating an activation circuit from an ignition circuit within an unmanned vehicle, the present invention may be adapted for various manned or unmanned, weapon or non-weapon applications including automotive, marine, aerospace, and other applications known in the art.

In the following description, various operating parameters and components are described for one constructed embodiment. These specific parameters and components are included as examples and are not meant to be limiting.

Figure 2:
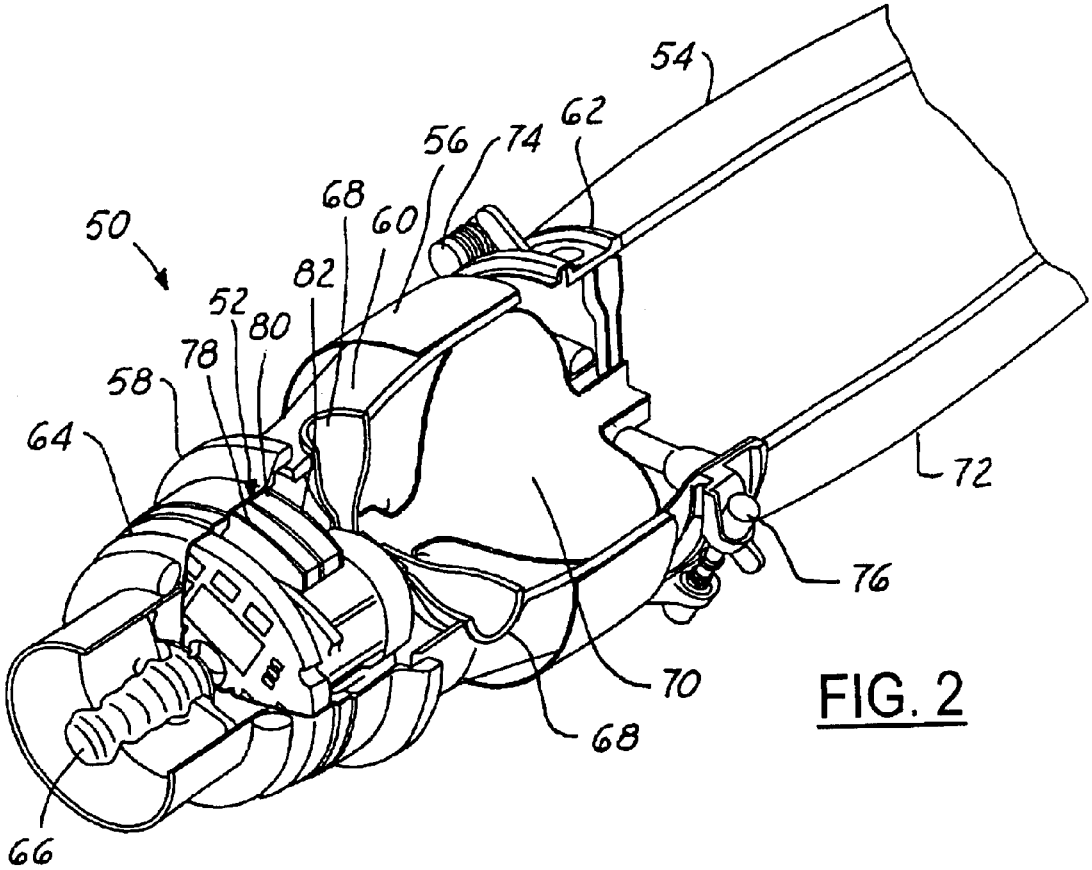
FIG. 2 is a perspective view of an unmanned vehicle utilizing an ignition isolating interrupt control circuit in accordance with an embodiment of the present invention.

Referring now to FIG. 2, a perspective view of an unmanned vehicle 50 utilizing an ignition isolating interrupt control circuit 52 in accordance with an embodiment of the present invention is shown. The interrupt circuit 52 is the first electronic controlled circuit approved by the NAVY Safety Review Board for isolating squibs from a battery. Previous circuits have required use of mechanical relays. The interrupt circuit 52 provides high malfunction tolerance and low leakage current. The interrupt circuit 52, although preferably solid-state, due to inherent solid-state advantages such as being lightweight, inexpensive, and durable, may be partially or fully formed of other similar electronic devices known in the art.

The unmanned vehicle 50 is in the form of a missile or weapon system 54 and is shown for example purposes only to illustrate and describe the present invention as may be used in one application. The vehicle 50, also known as a kinetic warhead, includes a guidance unit 58, a solid divert and attitude control system (SDACS) assembly 60, and an ejector assembly 62. The guidance unit 58 determines heading and operational performance of the weapon system 54. The guidance unit 58 includes a seeker assembly 64 for direction heading determination, via a radiation sensor assembly 66, and a guidance assembly 86 for thruster operation. The SDACS assembly 60 contains multiple attitude thrusters 68 with corresponding valves (not shown) and a gas generator 70 having a propellant stored in a solid form. The ejector assembly, 62 separates the warhead 56 from a lower portion 72 of the vehicle 50 upon initiation of the fourth stage. Thrusters 74 and actuator 76 are activated to aid in separation or ejection of the warhead 56 from the lower portion 72.

The guidance assembly 86 includes a guidance processor 78, a PCU 80, and an ordnance valve driver 82. In response to signals received from the radiation assembly 66 the guidance processor 78 determines an activation state of the vehicle 50. The guidance processor 78, during a fourth stage, receives power from the PCU 80 and enables the ordnance valve driver 82 to ignite propellant contained within the SDACS assembly 60. The guidance processor 78 upon ignition of the propellant activates the thrusters 68 to eject gaseous fuel generated from ignition of the propellant to modify heading direction and attitude of the warhead 56.

Figure 3:
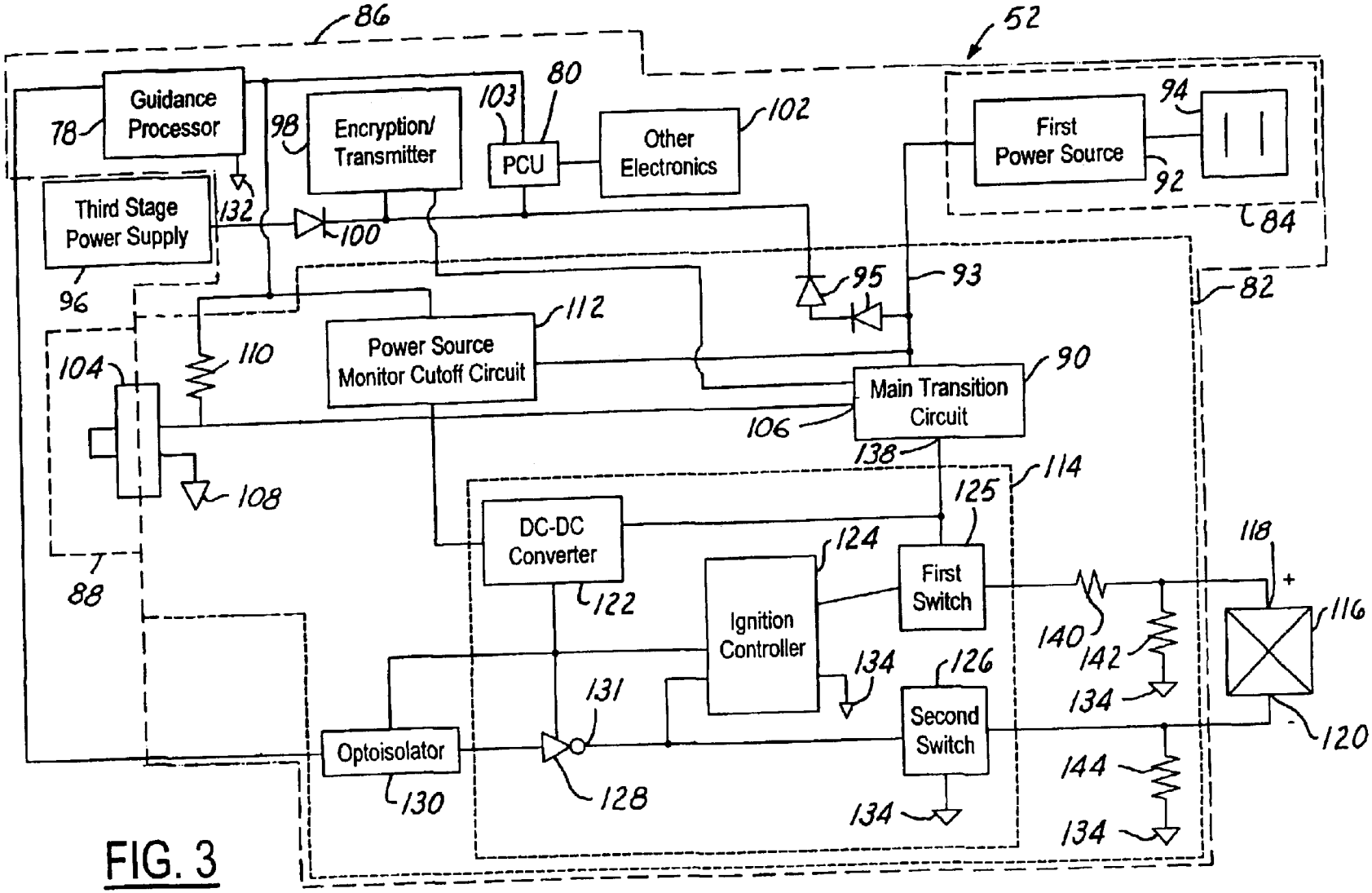
FIG. 3 is a block schematic view of the ignition isolating interrupt control circuit in accordance with an embodiment of the present invention.

Referring now to FIG. 3, a block schematic view of the interrupt circuit 52 in accordance with an embodiment of the present invention is shown. The interrupt circuit 52 includes a first activation circuit 84, a guidance assembly circuit 86, a second activation circuit 88, and the ordnance valve driver 82 having a main transition circuit 90.

The first activation circuit 84 includes a fourth stage power supply or battery or first power source 92 and an acceleration switch 94. When the warhead 56 exceeds a predetermined acceleration the power source 92 is activated by the switch 94 and thus supplies power to the ordnance valve driver 82, via a first source terminal 93. In one embodiment of the present invention the first source 92 supplies 28V to the source terminal 93. The power source 92 also provides power to an encryption/transmitter device 98 and the PCU 80, through a pair of blocking diodes 95.

The guidance assembly circuit 86 includes the guidance processor 78 that determines heading and operational performance of the warhead 56, as stated above. The guidance circuit 86 further includes the encryption device 98 and the PCU 80. The encryption device 98 and the PCU 80 receive power from a third stage power supply 96 via a first diode 100. The PCU 80 may be coupled to other electronic components, such as the seeker assembly 64, as designated by box 102. The PCU 80 supplies 5V to a second power source terminal 103, which is coupled to the guidance processor 78.

The second activation circuit 88 includes a separation device 104 electrically coupled to an input terminal 106 of the transition circuit 90 and to a first ground terminal 108. The separation device 104 is coupled to the second source 103, via a pull-up resistor 110. The second activation circuit 88 enables the transition circuit 90 when the separation device 104 separates during transition from the third stage to the fourth stage.

The ordnance valve driver 82 includes the transition circuit 90, a power source monitor cutoff circuit 112, and an ignition circuit 114. The transition circuit 90 isolates the first activation circuit 84 from the ignition circuit 114. The cutoff circuit 112 monitors the voltage level of the first source 92 and disables the ignition circuit 114 when the voltage level is less than a predetermined voltage level, thus accounting for a bleed down situation. For example, when the voltage level of the first source 92 is less than approximately 20V the cutoff circuit 112 disables the ignition circuit 114 to prevent inadvertent ignition. When the voltage level of the first source 92 is greater than approximately 20V, the cutoff circuit 112 enables the ignition circuit 114. Then, the ignition circuit 114 when receiving power from the first source 92, is enabled by the guidance processor 78, and is not disabled by the cutoff circuit 112, but activates an electro-explosive device or squib 116 to ignite propellant within the generator 70. The electro-explosive device 70 has a positive terminal 118 and a negative terminal 120.

The ignition circuit 114 includes a DC—DC converter 122, an ignition controller 124, a first switch 125 and a second switch 126. The DC—DC converter 122 is electrically coupled to the transition circuit 90 and the cutoff circuit 112. The DC—DC converter 122 converts voltage received from the first source 92 to an appropriate voltage level for powering the ignition controller 124, an inverter 128, and an optoisolator 130. The inverter 128 is coupled between the optoisolator 130 and the ignition controller 124. Inverted side 131 of the inverter 128 is also coupled to and enables the second switch 126. The optoisolator 130 performs as an isolated buffer to isolate a guidance circuit ground 132 from an ignition circuit ground 134. The ignition ground 134 is a common ground that is utilized by the first source 92 and the transition circuit 90. The guidance processor 78 is electrically coupled through the optoisolator 130 to the ignition controller 124 and activates the pair of switches 126. The first switch 125 is coupled to an output terminal 138 of the transition circuit 90 and to the electro-explosive device 116 via a current limiting resistor 140. A discharge resistor 142 is coupled between the positive terminal 118 and the ignition ground 134. A second discharge resistor 144 is coupled between the negative terminal 120 and the ignition ground 134.

The guidance processor 78 and the ignition controller 124 may be microprocessor based such as a computer having a central processing unit, memory (RAM and/or ROM), and associated input and output buses or may be a series of solid state logic devices. The guidance processor 78 and the ignition controller 124 may also be portions of a central main control unit, a flight controller, or may be stand-alone controllers as shown.

Figure 4:
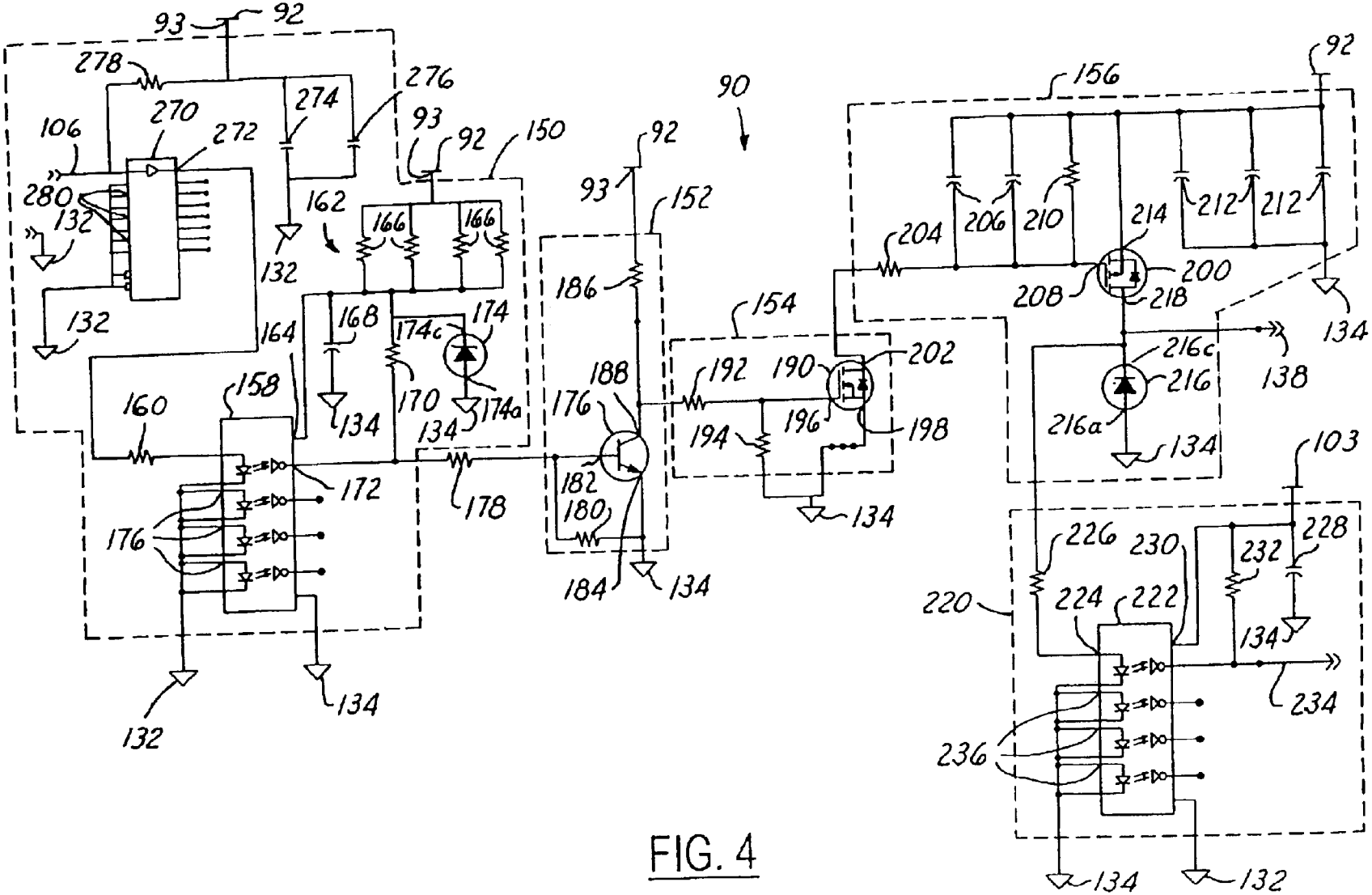
FIG. 4 is schematic diagram of a main transition circuit in accordance with an embodiment of the present invention.

Referring now to FIG. 4, a schematic diagram of the transition circuit 90 in accordance with an embodiment of the present invention is shown. The transition circuit 90 includes an intermediate circuit 150, an inverter circuit 152, an output switch driver 154, and an output switch 156.

In the following description, specific numerical values are given only by way of example. Those skilled in the art will recognize these values may be changed in view of different desired operating conditions and changes in the surrounding circuit. The intermediate circuit 150 includes a first buffer 270 and a first optocoupler 158. The buffer 270 is used for signal drive and noise immunity and may be of type number 54ACTQ541FMQB from National Semiconductor Corporation. A sixth capacitor 274 and a seventh capacitor 276 are coupled in parallel between the source terminal 93 and the circuit ground 132 and have capacitance of approximately 0.1 $\mu$F and 0.01 $\mu$F, respectively. The capacitors 274 and 276 may be replaced with an equivalent single capacitor, as known in the art. A sixth pull-up resistor 278 is coupled between the source terminal 93 and the input terminal 106 and has a resistance of approximately 3.01KΩ. Remaining buffer input terminals 280 are coupled to the circuit ground 132. A buffer output terminal 272 is coupled to a first resistor 160. The buffer drives and is coupled to an optocoupler 158, via the first resistor 160 having resistance of approximately 806 Ω. The first resistor 160 limits current flow into the optocoupler 158.

The optocoupler 158 isolates the guidance circuit ground 132 from the ignition ground 134. A first low pass filter circuit 162 exists between the first source 92 and a first supply terminal 164, including a series of parallel resistors 166 and a first capacitor 168. The parallel resistors 166 although each having a resistance of approximately 8.06KΩ may be replaced with an equivalent single resistor of larger wattage, as known in the art, and are coupled between the source terminal 93 and the first supply terminal 164. The first capacitor 168 as well as all other capacitors contained within the transition circuit 90 and the cutoff circuit 112 aid in minimizing noise content. The first capacitor 168 is coupled between the first supply terminal 164 and to the ignition ground 134 and has a capacitance of approximately 0.1 $\mu$F. A first pull up resistor 170 is coupled between the first supply terminal 164 and a first optocoupler output terminal 172 and limits current through the first optocoupler 158. The first pull-up resistor 170 has a resistance of approximately 2KΩ. A zener voltage regulator diode 174 is coupled between the first supply terminal 164 and the ignition ground 134 via a first cathode **174*c* and a first a node 174*a*, respectively, and maintains a constant voltage of approximately 5.1V at the first supply terminal 164. Remaining optocoupler input terminals 176 are not utilized and are coupled to the ignition ground 132. The zener diode 174** may be of type number jantxv1n4625ur-1 from Microsemi Corporation.

The inverter circuit 152 is in a common emitter configuration and includes a first transistor 176 coupled to the output terminal 172 via a second resistor 178. The first transistor 176 has a base terminal 182, an emitter terminal 184, and a collector terminal 188. A third resistor 180 is coupled between the first base terminal 182 and the first emitter terminal 184, which is coupled to the ignition ground 134. The second resistor 178 and the third resistor 180 have resistance values of approximately 6.81KΩ and 4.99KΩ, respectively. The second resistor 178 and the third resistor 180 perform as a voltage divider. A second pull-up resistor 186 is coupled between the source terminal 93 and the collector terminal 188 and has a resistance of approximately 10KΩ. The transistor 176 may be of type number 2N2222AUB from SEMICOA Semiconductors Corporation.

The output switch driver 154 includes a second transistor 190 that is coupled to the collector 188 via a fourth resistor 192 and provides proper divide down biasing voltage for the output switch 156. The transistor 190 has a first gate terminal 196, a first source terminal 198, and a first drain terminal 202. A fifth resistor 194 is coupled between the gate terminal 196 and the source terminal 198, which is coupled to the ignition ground 134. The fourth resistor 192 and the fifth resistor 194 also perform as a voltage divider and have resistance values of approximately 10Ω and 7.5KΩ, respectively. The second transistor 190 may be of type number IRF130 from International Rectifier Corporation.

The output switch 156 includes a third transistor 200 that is coupled to the drain terminal 202 via a sixth resistor 204. The third transistor 200 has a second gate terminal 208, a second source terminal 214, and a second drain terminal 218. A pair of capacitors 206 are coupled in parallel between the source terminal 93 and the second gate terminal 208 and each have a capacitance of approximately 0.47 μF. The capacitors 206 may be replaced with an equivalent single capacitor, as known in the art. A seventh resistor 210 is coupled between the source terminal 93 and the gate terminal 208 and provides source power to the gate terminal 208. The sixth resistor 204 and the seventh resistor 210 perform as a voltage divider and have resistance values of approximately 1.5KΩ and 1KΩ, respectively. A series of capacitors 212 are coupled in parallel between the source terminal 93 and the ignition ground 134, having a capacitance of approximately 82.11 μF. The source terminal 93 is coupled to the second source terminal 214. A rectifier 216 is coupled between the second drain terminal 218 and to the ignition ground 134 via a second cathode 216*c* and a second anode 216*a*, respectively. The second drain terminal 218 is coupled to the output terminal 138. The rectifier 216 provides load inductance protection. A suitable example of rectifier 216 is rectifier type number JANTXV1N5811US from Microsemi Corporation.

The transition circuit 90 may also include a status circuit 220, which includes a second optocoupler 222. The second optocoupler 222 isolates a main transition circuit ground 134 from a guidance circuit ground 132. The second optocoupler 222 has a second optocoupler input terminal 224 that is coupled to the output terminal 138 via an eighth resistor 226, which limits current flow into the optocoupler 222. The eighth resistor 226 has a resistance value of approximately 5.62KΩ. A second capacitor 228 is coupled between a second supply terminal 230 and to the ignition ground 134 and has a capacitance of approximately 0.1 μF. The second supply terminal 230 of 5V is also coupled to the second source 103. A third pull-up resistor 232 is coupled between the second source 103 and a second optocoupler output terminal 234 and limits current through the output terminal 234. The pull-up resistor 232 has a resistance value of approximately 2KΩ. As with the first optocoupler 158, remaining second optocoupler input terminals 236 are coupled to the ignition ground 134. The output terminal 234 is coupled to the guidance processor 78 for status, which is later sent to the transmitter 98. In a constructed embodiment, the optocouplers 158 and 222 optocouplers having type number 8302401EX from MicroPac Corporation were used.

The status circuit 220 generates a status signal, which is transmitted by the transmitter 98 to an earth station (not shown). The status signal reflects status of the output terminal 138.

Figure 5:
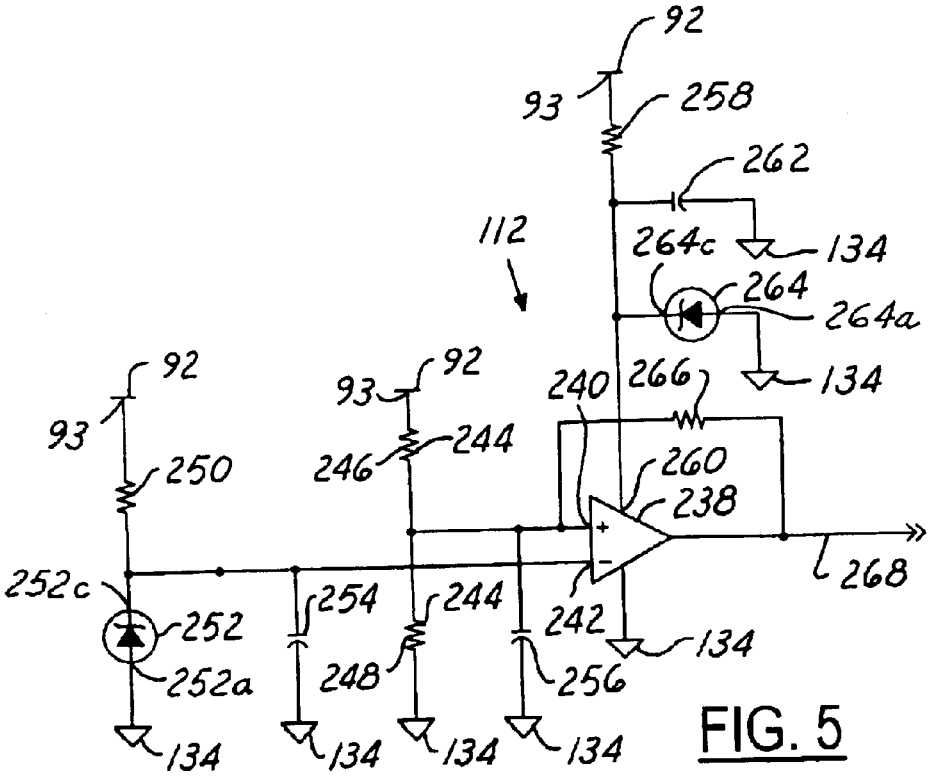
FIG. 5 is a schematic diagram of a power source monitor cutoff circuit in accordance with an embodiment of the present invention.

Referring now to FIG. 5, a schematic diagram of the cutoff circuit 112 in accordance with an embodiment of the present invention is shown. The cutoff circuit 112 includes a comparator 238 having a non-inverting input terminal 240 and an inverting input terminal 242. A pair of resistors 244 perform as a divider circuit of the first source 92. A ninth resistor 246 is coupled between the source terminal 93 and the non-inverting terminal 240 and has a resistance value of approximately 8.66KΩ. A tenth resistor 248 is coupled between the non-inverting terminal 240 and the ignition ground 134 and has a resistance value of approximately 3.01KΩ. A fourth pull-up resistor 250 is coupled between the source terminal 93 and the inverting terminal 240 and has a resistance value of approximately 10KΩ. A second zener diode 252 is coupled between the inverting terminal 242 and the ignition ground 134 via a third cathode 252*c* and a third anode 252*a*, respectively. The second diode 252, in conjunction with the resistor 250, maintains a constant reference voltage level at the inverting terminal 242 of approximately 5.1 volts.

The comparator 238 compares voltage level at the non-inverting terminal 240 with voltage level at the inverting terminal 242 in generating a source status signal. A third capacitor 254 is coupled between the inverting terminal 242 and the ignition ground 134. The capacitors 254 and 256 each have capacitance of approximately 0.01 μF. A fourth capacitor 256 is coupled between the inverting terminal 242 and the ignition ground 134. A fifth pull-up resistor 258 is coupled between the source terminal 93 and a comparator supply terminal 260 and has a resistance value of approximately 1KΩ. A fifth capacitor 262 is coupled between the supply terminal 260 and the ignition ground 134 and has a capacitance of approximately 0.1 μF. A third zener diode 264 is coupled between the supply terminal 260 and the ignition ground 134 via a fourth cathode 264*c* and a fourth anode 264*a*, respectively. The third diode 264 limits voltage level to the supply terminal 260 to approximately 30V. A feedback resistor 266 is coupled between the non-inverting terminal 240 and a converter output terminal 268, which is coupled to the DC—DC converter 122. The feedback resistor 266 has a resistance value of approximately 100KΩ.

Resistors 160, 166, 170, 178, 180, 186, 192, 194, 226, 232, 244, 250, 258, 266, and 278 have a power rating of approximately 0.25 watts. Resistors 204 and 210 have a power rating of approximately 0.74 watts. All of the above stated resistor and capacitor values and power ratings may be varied, depending upon the application, as known in the art.

Figure 6:
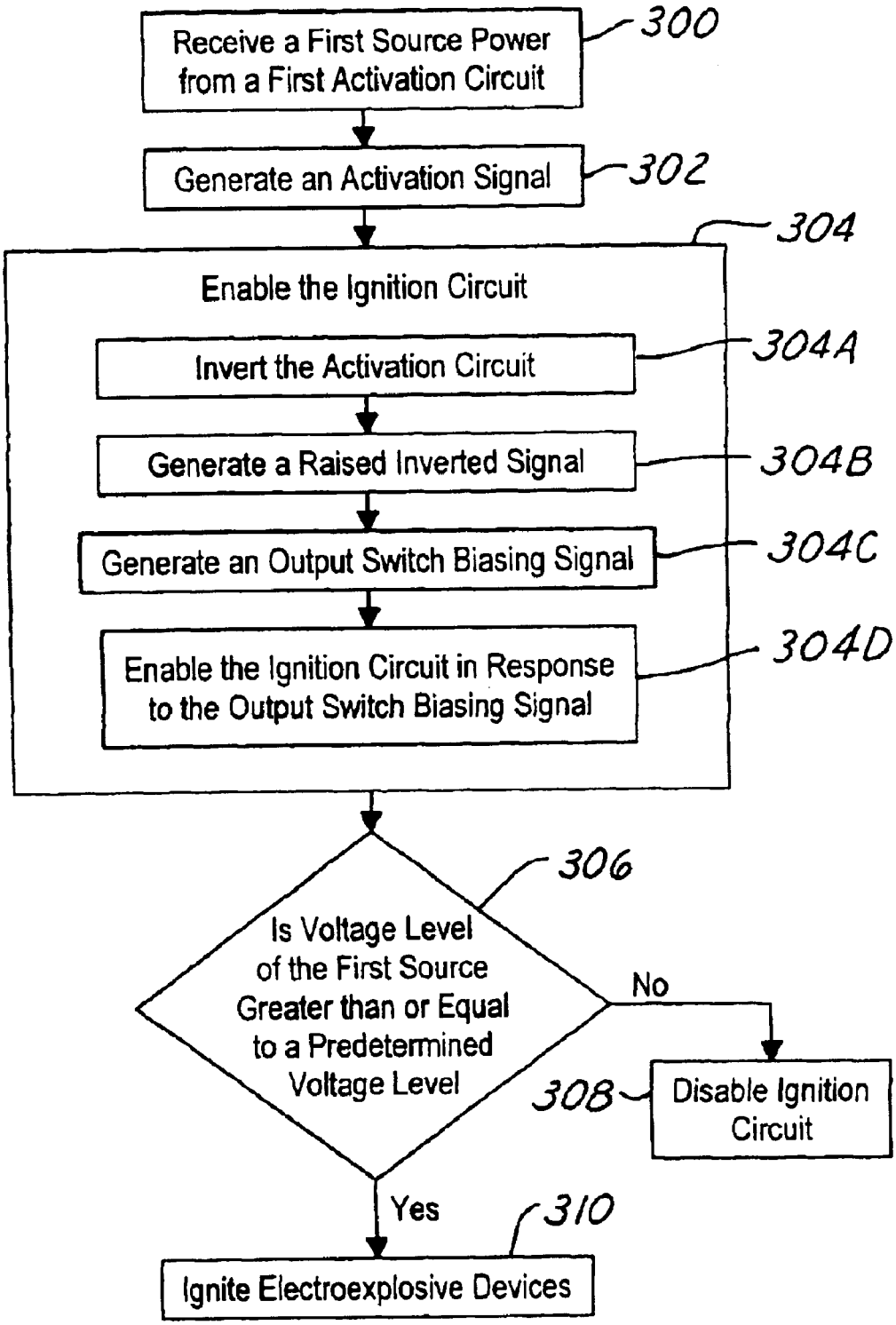
FIG. 6 is a logic flow diagram illustrating a method of isolating an ignition circuit from a first activation circuit in accordance with an embodiment of the present invention.

Referring now to FIG. 6, a logic flow diagram illustrating a method of isolating the ignition circuit 114 from the first activation circuit 84 in accordance with an embodiment of the present invention is shown.

In step 300, the transition circuit 90 receives power from the first source 92. In step 302, the separation device 104 separates and the intermediate circuit 150 receives an activation signal from the second activation circuit 88 via the input terminal 106.

In step 304, the transition circuit 90 enables the ignition circuit 114 in response to the activation signal. In step 304A, the first optocoupler 158 inverts the activation signal. For example, when the activation signal is in a high state, output from the optocoupler 158 at the first output terminal 172, is in a low state. In step 304B, the inverter circuit 152 inverts the activation signal and performs as a transition from voltage of the second source 103 to voltage of the first source 93 to generate a raised inverted signal. For example, the inverter circuit 152 may be a transition from 5v to 28V, respectively. In step 304C, the output switch driver 154 inverts the raised inverted signal to generate an output switch-biasing signal. In step 304D, the output switch 156 enables the ignition circuit 114 in response to the output switch-biasing signal. The output terminal 138 receives and supplies power from the first source 92 to the DC—DC converter 122 and to the first switch 125.

In step 306, the cutoff circuit 112 enables the DC—DC converter 122 when voltage output potential of the first source 92 is above a predetermined level. When the voltage level at terminal 240,is greater than or equal to the voltage level at terminal 242 the comparator 238 enables the DC—DC converter 122. The DC—DC converter 122 converts voltage received from the first source 92 to a proper voltage level to power the ignition controller 124, the inverter 128, and the optoisolator 130.

In step 308, the cutoff circuit 112 disables the DC—DC converter 122 when the voltage level of the first source 92 is less than the predetermined voltage level, thus preventing the ignition controller 124 from receiving power to enable the electro-explosive devices 116. For example, when voltage potential output of the first source decreases from 28V to a level less than approximately 20V, the DC—DC converter 122 is disabled.

In step 310, the ignition controller 124 receives a pre-ignition signal from the guidance processor 78 upon initiation of the fourth stage through the optoisolator 130 and generates an ignition signal. The first switch 125 and the second switch 126 in response to the ignition signal switch to an "ON" state to ignite the electro-explosive device 116.

The above-described steps are meant to be an illustrative example, the steps may be performed sequentially, synchronously, continuously, or in a different order depending upon the application.

The present invention provides an isolating interrupt control circuit that satisfies or exceeds current safety requirements for smaller unmanned vehicles. The present invention is relatively small in size and light in weight compared to traditional interrupt circuits and accounts for power source bleed down situations.

The above-described apparatus and method, to one skilled in the art, is capable of being adapted for various applications and systems known in the art. The above-described invention can also be varied without deviating from the true scope of the invention.

What is claimed is:

1. An ignition isolating interrupt control circuit comprising:

a main transition circuit isolating a first activation circuit from an ignition circuit, said main transition circuit comprising:

at least one source terminal electrically coupled to and receiving a first source power from said first activation circuit;

an input terminal electrically coupled to a second activation circuit and receiving an activation signal; and an output terminal electrically coupled to said ignition circuit and receiving and supplying said first source power to said ignition circuit in response to said activation signal; and a power source monitor cutoff circuit comprising a comparator electrically coupled to said first activation circuit and to said ignition circuit and disabling said ignition circuit when a source voltage level of said main transition circuit is less than a predetermined voltage level.

2. A circuit as in claim 1 wherein said ignition isolating interrupt control circuit is formed at least partially of solid-state electronic devices.

3. A circuit as in claim 1 wherein said main transition circuit comprises at least one switch enabling said ignition circuit in response to said activation signal.

4. A circuit as in claim 1 wherein said main transition circuit comprises:

an intermediate circuit isolating a guidance circuit ground from a main transition circuit ground and inverting said activation signal;

an inverter circuit electrically coupled to said intermediate circuit and generating a raised inverted signal in response to said inverted activation signal;

an output switch driver electrically coupled to said inverter circuit and generating an output switch biasing signal in response to said raised inverted signal; and an output switch electrically coupled to said output switch driver and enabling said ignition circuit in response to said output switch biasing signal.

5. A circuit as in claim 4 wherein said intermediate circuit comprises a buffer.

6. A circuit as in claim 1 further comprising a status circuit generating a status signal.

7. A circuit as in claim 6 wherein said status circuit is contained within said main transition circuit.

8. A circuit as in claim 6 wherein said status circuit isolates a main transition circuit ground from a guidance circuit ground.

9. A circuit as in claim 1 wherein said first activation circuit comprises an acceleration sensing device enabling a power source when a predetermined acceleration value is exceeded.

10. A circuit as in claim 1 wherein said second activation circuit comprises:

a separation device electrically coupled to said input terminal and to a ground terminal; and a second power source electrically coupled to said input terminal and to said separation device;

said second activation circuit enabling said main transition circuit with power from said second power source when said separation device separates.

11. A vehicle having an ignition isolating interrupt control circuit comprising;

a first activation circuit;

a second activation circuit generating an activation signal; and an ordnance valve driver comprising;

an ignition circuit; and a main transition circuit isolating said first activation circuit from said ignition circuit, said main transition circuit comprising:

at least one source terminal electrically coupled to and receiving a first source power from said first activation circuit;

an input terminal electrically coupled to said second activation circuit and receiving said activation signal; and an output terminal electrically coupled to said ignition circuit and receiving and supplying said first source power to said ignition circuit in response to said activation signal; and a power source monitor cutoff circuit comprising a comparator electrically coupled to said first activation circuit and to said ignition circuit and disabling said ignition circuit when a source voltage level of said main transition circuit is less than a predetermined voltage level.

12. A vehicle as in claim 11 wherein said ignition isolating interrupt control circuit is formed at least partially of solid-state electronic devices.

13. A vehicle as in claim 11 wherein said isolating interrupt control circuit further comprises a communication circuit transmitting a status signal.

14. A vehicle as in claim 11 wherein said first activation circuit comprises an acceleration sensing device enabling a power source when a predetermined acceleration value is exceeded.

15. A vehicle as in claim 11 wherein said second activation circuit comprises:

a separation device electrically coupled to said input terminal and to a ground terminal; and a second power source electrically coupled to said input terminal and to said separation device;

said second activation circuit enabling said main transition circuit with power from said second power source when said separation device separates.

16. A vehicle as in claim 11 wherein said ignition circuit comprises:

a direct current to direct current converter electrically coupled to said main transition circuit and said monitor cutoff circuit;

an ignition controller electrically coupled to a guidance processor and said direct current to direct current converter and generating an ignition signal in response to a pre-ignition signal; and at least one switching device electrically coupled to said main transition circuit and said ignition controller and enabling at least one electro-explosive device in response to said ignition signal.

17. A vehicle as in claim 11 wherein said main transition circuit comprises at least one switch enabling said ignition circuit in response to said activation signal.

18. A vehicle as in claim 11 wherein said main transition circuit comprises at least one switch:

an intermediate circuit isolating a guidance circuit ground from a main transition circuit ground and inverting said activation signal;

an inverter circuit electrically coupled to said intermediate circuit and generating a raised inverted signal in response to said inverted activation signal;

an output switch driver electrically coupled to said inverter circuit and generating an output switch biasing signal in response to said raised inverted signal; and an output switch electrically coupled to said output switch driver and enabling said ignition circuit in response to said output switch biasing signal.

* * * * *